US008686274B2

(12) United States Patent
Fukuda et al.

(10) Patent No.: US 8,686,274 B2
(45) Date of Patent: Apr. 1, 2014

(54) PITCH SHIFT DEVICE AND PROCESS

(75) Inventors: Yasuhiro Fukuda, Hamamatsu (JP); Shoichi Ikeda, Hamamatsu (JP)

(73) Assignee: Roland Corporation, Hamamatsu (JP)

( * ) Notice: Subject to any disclaimer, the term of this patent is extended or adjusted under 35 U.S.C. 154(b) by 122 days.

(21) Appl. No.: 13/301,635

(22) Filed: Nov. 21, 2011

(65) Prior Publication Data

US 2012/0137856 A1 Jun. 7, 2012

(30) Foreign Application Priority Data

Dec. 7, 2010 (JP) ..... 2010-272268

(51) Int. Cl.
*G10H 1/00* (2006.01)

(52) U.S. Cl.
USPC ..... 84/616; 84/609; 84/626; 84/649; 84/654; 84/662

(58) Field of Classification Search
None
See application file for complete search history.

(56) References Cited

U.S. PATENT DOCUMENTS

| | | | | |
|---|---|---|---|---|
| 7,514,620 | B2 * | 4/2009 | Friedman et al. | 84/454 |
| 8,244,546 | B2 * | 8/2012 | Nakano et al. | 704/500 |
| 2012/0137856 | A1 * | 6/2012 | Fukuda et al. | 84/616 |
| 2012/0294457 | A1 * | 11/2012 | Chapman et al. | 381/98 |
| 2012/0294459 | A1 * | 11/2012 | Chapman et al. | 381/98 |

FOREIGN PATENT DOCUMENTS

| | | |
|---|---|---|
| JP | 06-012072 | 1/1994 |
| JP | 08-171387 | 7/1996 |

* cited by examiner

*Primary Examiner* — Marlon Fletcher
(74) *Attorney, Agent, or Firm* — Foley & Lardner LLP

(57) ABSTRACT

A pitch shift device provides pitch-shifted sounds based on performance sounds generated by an electronic string musical instrument. The pitch shift device has a device that detects vibrato. When vibrato is detected, an interpolation device of a pitch shift control device performs a control of interpolating for a pitch shift change in the musical sound signal accompanying a change in pitch shift information stored in a pitch information storage device and read out by a pitch shift readout device from a group of pitch shift information. Therefore, unnatural pitch changes in pitch-shifted sound can be suppressed.

20 Claims, 7 Drawing Sheets

(a)

(Pitch Shift Amount Table)

| | C | C# | D | D# | E | F | F# | G | G# | A | A# | B |
|---|---|---|---|---|---|---|---|---|---|---|---|---|
| +3rd | 4 | 3 | 3 | 3 | 3 | 4 | 4 | 4 | 3 | 3 | 3 | 3 |

(b)

(c)

PITCH SHIFT DEVICE AND PROCESS

CROSS-REFERENCE TO RELATED PATENT APPLICATIONS

Japan Priority Application No. 2010-272268, filed Dec. 7, 2010, including the specification, drawings, claims and abstract, is incorporated herein by reference in its entirety.

FIELD OF THE INVENTION

Embodiments of the invention relate to pitch shift devices and processes and, in particular embodiments, to a pitch shift device that can suitably obtain, from performance sound generated by an electronic string musical instrument, sound that is pitch-shifted from the performance sound (pitch-shifted sound).

BACKGROUND

An example of a pitch shifting device that shifts the pitch of input sound by a predetermined pitch shift amount and outputs the pitch-shifted sound is described, for example, in Laid-open patent application HEI 8-171387. That reference describes a pitch shifter (i.e., a pitch shift device) that outputs more musically natural pitch-shifted sound. The pitch shifter stores, in advance, a table that specifies the amount of pitch shift for each pitch (C, $C^{\#}$, D, $D^{\#}$, . . . , $A^{\#}$, B) of an input sound, for adjusting the pitch after pitch shift so as to make it sound more musically natural. The stored pitch shift amount includes pitch shift amounts corresponding to a key and a scale at the time of performance, which can be set by the performer. The stored pitch shift amount also includes shift information indicative of a pitch (for example, $+3^{rd}$, $-3^{rd}$ or the like). The pitch shifter changes the pitch of input sound using a pitch shift amount table, according to key information (a key and a scale) set by the performer and shift information.

FIG. 7 (*a*) is a schematic diagram showing an example of contents of a pitch shift amount table. The pitch shifter described in Laid-open patent application HEI 8-171387 uses a similar table. The pitch shift amount table shown in FIG. 7 (*a*) is a table that is referred to when the key information is set at C (C major) or Am (A minor), and the shift information is set at +third ($+3^{rd}$). In the pitch shift amount table, pitches that are expressed by note names described in an upper row correspond to pitch shift amounts in the unit of a halftone described in a lower row, respectively. The upper row is referred to according to the pitch of an input sound, and the corresponding amount of pitch shift in the lower row is determined. The lower row of the table shown in FIG. 7 (*a*) describes numbers "3" and "4" as the amounts of pitch shift. Each of the numbers indicates "three halftones (minor $3^{rd}$)" or "four halftones (major $3^{rd}$)," respectively. In other words, in the exemplary pitch shift amount table, the pitch shift amount specified for the pitch of an input sound is either +three halftones (minor $3^{rd}$) or +four halftones (major $3^{rd}$). More specifically, when the pitch of an input sound is either "$C^{\#}$," "D," "$D^{\#}$," "E," $G^{\#}$," "A," "$A^{\#}$" or "B," the pitch shift amount is specified to be +three halftones; and when the pitch of an input sound is "C," "F," "$F^{\#}$" or "G," the pitch shift amount is specified to be +four halftones.

FIG. 7 (*b*) is a graph showing temporal changes in the pitch of each of the sounds when performed with an electronic guitar by an ordinary performance method (a fret changing method), when a harmony sound is to be added to the input sound using the pitch shift amount table shown in FIG. 7 (*a*). The horizontal axis of the graph shows time, and the vertical axis shows note names of the respective input sounds (pitches). According to the graph shown in FIG. 7 (*b*), when an input sound 101 of "G" is inputted at time t1, a harmony sound 102 of "B" that is four halftones above "G" based on the pitch shift amount table of FIG. 7 (*a*) is outputted together with the input sound 101. Thereafter, consider a case where the input sound 101 is changed, for example, from "G" to "A" at time t2 by an ordinary performance method (through changing the fret). In this case, as shown in FIG. 7 (*b*), as the input sound changes from "G" to "A" at time t2 as a boundary, the harmony sound 102 also changes from "B" to "C" at time t2 as a boundary.

When the input sound 101 is "G," then "B" (which is four halftones above "G") is a musically natural harmony sound; and when the input sound 101 is "A," then "C" (which is three halftones above "A") is a musically natural harmony sound. Therefore, by using the pitch shift amount table of FIG. 7 (*a*), natural harmony sounds can be automatically added to performance sounds of an electronic guitar.

However, when pitch shifting is performed using the pitch shift amount table, unnatural pitch changes can occur when finger bending is performed.

FIG. 7 (*c*) is a graph showing temporal changes in the pitch of each of the sounds when performed with an electronic guitar by a bending performance method, and when harmony sound is to be added to the input sound using the pitch shift amount table shown in FIG. 7 (*a*) according to a conventional method. The horizontal axis of the graph shows time, and the vertical axis shows note names of the respective input sounds. Consider, for example, a case where an input sound 101 of "G" is inputted at time t1 and, thereafter, finger bending is started at time t2*a* to change the pitch of the input sound 101 from "G" to "A" at time t2*c*. In this case, as pitch of the input sound 101 rises, the pitch of the harmony sound 102 rises from "B" at time t2*a* and thereafter, while keeping the pitch difference of four halftones with respect to the pitch of the input sound. However, at time t2*b*, when the pitch of the input sound 101 is detected as "$G^{\#}$," the pitch of the harmony sound 102 is set at "B" that is three halftones above "$G^{\#}$," based on the pitch shift amount table of FIG. 7 (*a*). In this case, the pitch of the harmony sound 102 abruptly drops, which results in a pitch change that sounds unnatural.

SUMMARY OF THE DISCLOSURE

Embodiments of the invention relate to a pitch shift device for providing pitch-shifted sounds based on performance sounds generated by an electronic string musical instrument (for example, a guitar, a bass or the like).

A pitch shift device according to an embodiment of the present invention is equipped with a bending detection device that detects bending performed on an electronic string musical instrument, a pitch shift information readout device that reads out pitch shift information from a group of pitch shift information stored in a pitch information storage device (which correlates pitch information of each musical sound signal with pitch shift information for shifting the pitch of the pitch information), and a pitch shift control device having an interpolation device that performs, when bending is detected by the bending detection device, a control of interpolating for a pitch shift change in the musical sound signal accompanying a change in the pitch shift information read out by the pitch shift readout device. Therefore, it is possible to suppress pitch changes that sound artificial in pitch-shifted sound (a pitch-shifted musical sound signal), which could occur when pitch shifting of pitch information of a musical sound signal generated by an electronic string musical instrument and inputted through an input device is performed based on the pitch shift information readout from the group of pitch shift information. It is therefore possible to suppress unnatural pitch changes in pitch-shifted sound (pitch-shifted musical sound signals), which could occur when pitch shift is performed, based on the pitch shift information read out from the group of pitch shift information, on musical sound signals of an electronic string musical instrument inputted from an input device. Accordingly, pitch-shifted sound can be suitably obtained based on performance sound generated by an electronic string musical instrument.

In another example of a pitch shift device according to the above-described embodiment, groups of pitch shift information can be selected by a selection device, such that a group of pitch shift information most suitable for the performance can be selected, and therefore pitch shift sounds that are most suitable for the performance can be obtained. Moreover, although any one of groups of pitch shift information can be arbitrarily selected, regardless of whichever group of pitch shift information is selected, an interpolation control by the interpolation device is performed when bending is detected. Therefore, the pitch shift device can provide pitch sounds most suitable for the performance, with unnatural pitch changes being well suppressed.

BRIEF DESCRIPTION OF THE DRAWINGS

FIG. 7(*b*) is a graph representing temporal changes in the pitch of each of the sounds when performed with an electronic guitar by an ordinary performance method, when a harmony sound is to be added to an input sound using the pitch shift amount table shown in FIG. 7(*a*).

FIG. 7(*c*) is a graph representing temporal changes in the pitch of each of the sounds when performed with an electronic guitar by a bending performance method, when a harmony sound is to be added to an input sound using the pitch shift amount table shown in FIG. 7(*a*).

DETAILED DESCRIPTION

Figure 1:
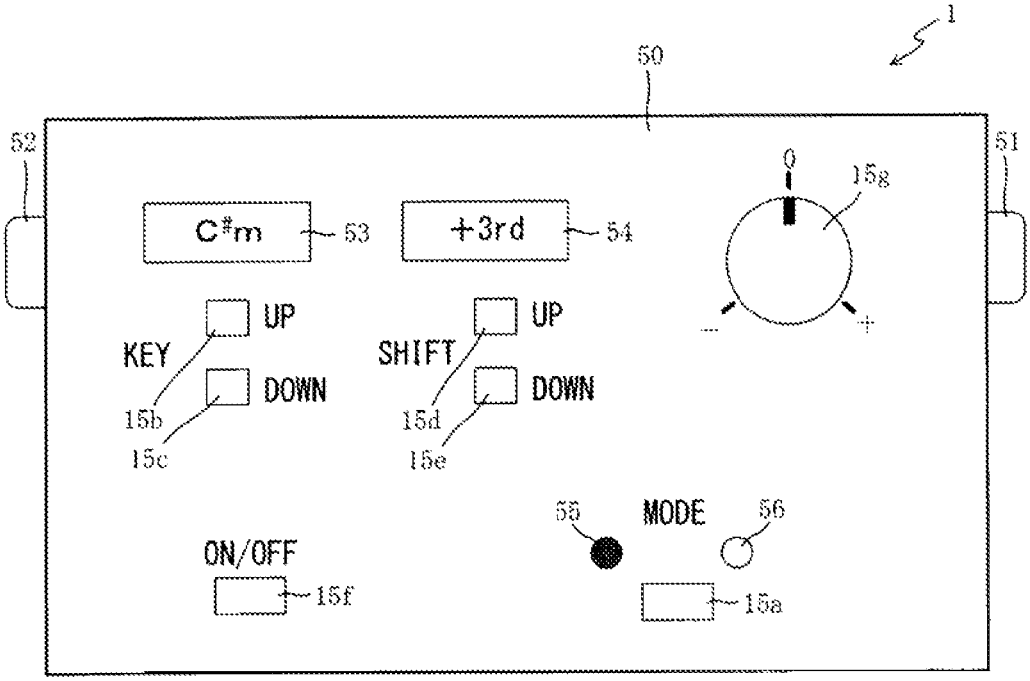
FIG. 1 is a schematic drawing of an external appearance of a pitch shift device in accordance with an embodiment of the invention.

An embodiment of the invention will be described below with reference to the accompanying drawings. FIG. 1 is a schematic view showing an external appearance of a pitch shift device 1 in accordance with an embodiment of the invention. The pitch shift device 1 is an output device that generates pitch shifted sound of input sound (performance sound) inputted by the performance of an electronic string musical instrument (for example, an electronic guitar, an electronic bass or the like), and outputs the pitch shifted sound.

In accordance with the present embodiment, an operation element 15*a* is a mode changing switch that can switch the device between two modes by the operation of the operation element 15*a*. A first mode is a harmony mode in which input sound is outputted as the first output sound; and pitch-shifted sound of the input sound is generated according to the pitch of the input sound, and the pitch-shifted sound is outputted as the second output sound. The aforementioned "second output sound" is referred to below as the "harmony sound." The second mode is a pitch shift mode in which pitch-shifted sound alone is outputted, for example, performance sound is pitch-shifted and outputted.

The pitch shift device 1 includes a housing 50 having an operation panel on its front surface, an input terminal 51, and an output terminal 52. When an output of an electronic string musical instrument, such as, an electronic guitar, an electronic bass or the like is connected to the input terminal 51, and performance sound signals from the connected electronic string musical instrument are inputted as input sound through the input terminal 51 into the pitch shift device 1, output sound signals according to the set mode are outputted through the output terminal 52, and the output sound signals are supplied to an amplifier connected to the output terminal 52. It is noted that an output of an effector may be connected to the input terminal 51, and performance sound signals added with effects may be inputted as input sound. Similarly, a device that is to be connected to the output terminal 52 need not be limited to an amplifier and may be, for example, another effector.

FIG. 1 illustrates the pitch shift device 1 with its operation panel on the housing 50 facing outward from the paper surface. The operation panel is provided with various operation elements 15*a*-15*g*, a key information display section 53 that displays set key information, a shift information display section 54 that displays set shift information, and set mode display LEDs 55 and 56 that are lit according to the set mode.

The operation element 15*a* is a mode changing switch for setting an output mode of pitch-shifted sounds, and, in the illustrated example, is configured as a button switch that can be operated by depressing the switch. Each time the operation element 15*a* is operated, the mode is switched between the harmony mode and the pitch shift mode. The set mode display LED 55 is lit when the harmony mode is set, and the other set mode display LED 56 is lit when the pitch shift mode is set. The lit states of the set mode display LED 55 and the set mode display LED 56 change each time the operation element 15*a* is operated. It is noted that, in the example shown in FIG. 1, the set mode display LED 55 is lit, which indicates that the mode is set to the harmony mode.

The operation elements 15*b* and 15*c* are key information set switches that are used by the user to set key information and, in the illustrated example, are configured as button switches that can be operated by depressing the switches. The operation element 15*b* is a switch that can sequentially change the key information from C major→$C^{\#}$ major→D major→$A^{\#}$ major→B major→C minor→$C^{\#}$ minor→D minor→$A^{\#}$ minor→B minor in this order. On the other hand, the operation element 15*c* is a switch that can change the key information in the reverse order with respect to the changes made by the operation element 15*b*. The key information display section 53 is a screen for displaying key information set by the user, and displays, each time the operation element 15*b* or 15*c* is operated, key information according to the operation. In the example shown in FIG. 1, the key information display section 53 displays "C#m," which indicates that the set key information is C#m (C# minor).

The operation elements 15*d* and 15*e* are shift information set switches for setting shift information and, in the illustrated embodiment, are configured as button switches that are operated by depressing the switches. In accordance with the present embodiment, four intervals (−fifth, −third, +third and fifth) are provided as shift information used in the harmony mode. Also, seven sets of shift information (−1 octave, −700 cents, −500 cents, +300 cents, +500 cents, +700 cents, and +1 octave) are provided as shift information used in the pitch shift mode.

When the harmony mode is set, the operation element 15*d* functions as a switch that can sequentially change the shift information from −fifth→−third→+third→+fifth in this order, and the operation element 15*e* functions as a switch that can sequentially change the shift information in the reverse order (i.e., +fifth→+third→−third→−fifth). On the other hand, when the pitch shift mode is set, the operation element 15*d* functions as a switch that can sequentially change the shift information from −1 octave→−700 cents→−500 cents→+300 cents→+500 cents→+700 cents→+1 octave in this order, and the operation element 15*e* functions as a switch that can sequentially change the shift information in the reverse order. The shift information display section 54 is a screen that displays the set shift information, and displays, each time the operation element 15*d* or 15*e* is operated, shift information set according to the operation. In the example shown in FIG. 1, the shift information display section 54 displays "+3rd," which indicates that the set shift information is +third.

The operation element 15*f* is an ON/OFF switch for switching between ON and OFF of the effect (pitch shift) in the pitch shift mode. In the illustrated embodiment, the operation element 15*f* is configured as a button switch that is operated by depressing the switch, and switches the effect between ON and OFF each time it is operated.

The operation element 15*g* is a time setting knob for setting, when the effect is switched from OFF to ON in the pitch shift mode, a time period up to a point when the effect becomes fully effective (hereafter, this period is called the "first time"), and for setting, when the effect is switched from ON to OFF, a time period until the pitch returns to the original pitch (hereafter, this period is called the "second time"). By rotating the operation element 15*g*, the first time and the second time can be set. When the operation element 15*g* is set at "0 (zero)," the first time and the second time are set at a predetermined reference time. When the operation element 15*g* is rotated to the +direction (clockwise) from "0 (zero)," the first time and the second time can be made longer than the reference time; and the greater the amount of rotation thereof, the longer the first time and the second time can be set. On the other hand, when the operation element 15*g* is rotated to the − direction (counterclockwise) from "0 (zero)," the first time and the second time can be made shorter than the reference time; and the greater the amount of rotation thereof, the shorter the first time and the second time can be set.

According to the pitch shift device 1 of the present embodiment, when the mode is set in the harmony mode, an input sound is shifted in pitch by a pitch shift amount decided, thus generating a harmony sound. The pitch shift amount is decided, referring to the pitch shift amount table 12*b* (see FIG. 2) that is selected based on key information set by the operation element 15*b* or 15*c* and shift information set by the operation element 15*d* or 15*e*, according to pitch information indicative of the pitch of an input sound.

Also, when the mode is set in the pitch shift mode, and the effect is set to ON, the pitch shift device 1 pitch-shifts input sound by the amount of pitch shift indicated by shift information set by the operation element 15*d* or 15*e*, thus generating pitch-shifted sound. When the mode is set in the pitch shift mode, and the effect is switched by operation of the operation element 15*f* (an ON/OFF switching switch) from OFF to ON or from ON to OFF, the pitch shift device 1 adjusts the crossfade time for crossfading the input sound with the pitch-shifted sound. Further details of this operation are described below. Further, the crossfade time has a value according to the shift information (the amount of pitch shift) set by the operation element 15*d* or 15*e*, and the first time and the second time set by the operation element 15*g*.

Figure 2:
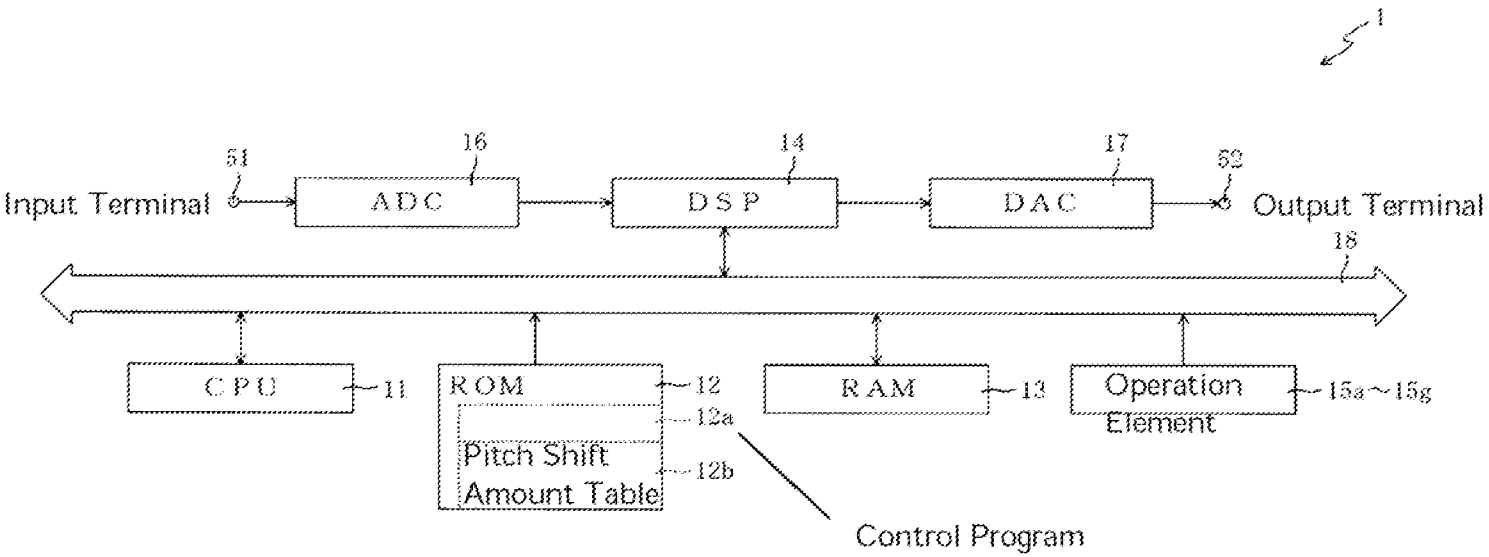
FIG. 2 is a block diagram of an electrical configuration of the pitch shift device in accordance with an embodiment of the invention.

FIG. 2 is a block diagram of the electrical configuration of the pitch shift device 1. The pitch shift device 1 has a CPU 11, a ROM 12, a RAM 13, a DSP 14, the operation elements 15*a*-15*g* described above, an analog-to-digital converter (ADC) 16, and a digital-to-analog converter (DAC) 17. The units 11-17, except the ADC 16 and the DAC 17, are mutually connected through a bus line 18. The ADC 16 and the DAC 17 are connected to the DSP 14. Also, the ADC 16 is connected to an input terminal 51, and the DAC 17 is connected to an output terminal 52.

The CPU 11 is a central control unit that controls the components of the pitch shift device 1 according to fixed values data and control programs stored in the ROM 12 and the RAM 13. The ROM 12 is a rewritable memory, and stores a control program 12*a* for the CPU 11 and the DSP 14 to execute various processes, and that renders fixed values data (not shown) that are referred to by the CUP 11 when the control program 12*a* is executed.

Figure 7:
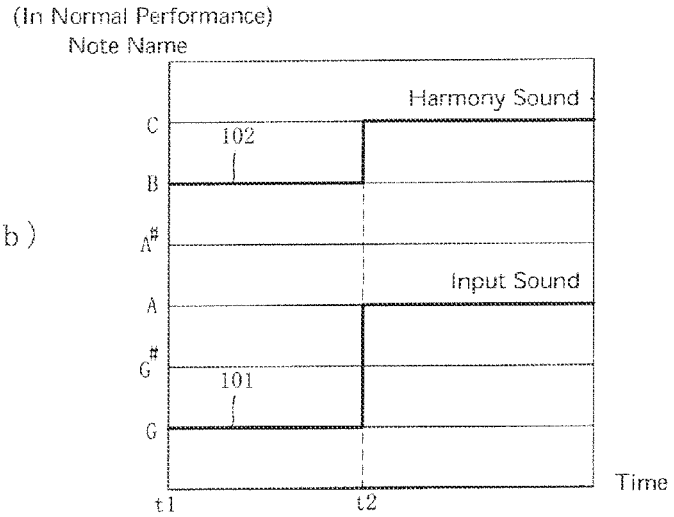
FIG. 7(*a*) is a schematic diagram of an example of contents of a pitch shift amount table.
Figure 7:
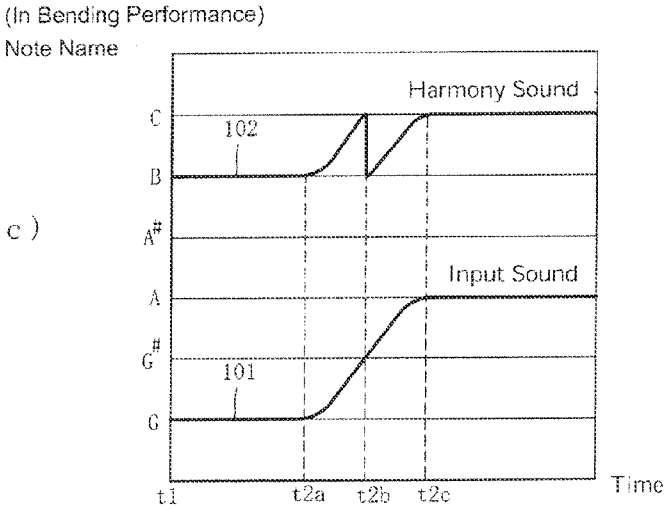

The ROM 12 also stores a pitch shift amount table 12*b* that is referred to in the harmony mode. The pitch shift amount table 12*b* may be a table similar to the pitch shift amount table shown in FIG. 7 (*a*) (key information: C major or A minor, shift information: +third), and may be composed of a plurality of pitch shift amount tables 12*b*. In accordance with the present embodiment, one of the pitch shift amount tables 12*b* is selected for reference from among the plurality of stored pitch shift amount tables 12*b* according to shift information set by the operation element 15*d* or 15*e*, and key information set by the operation element 15*b* or 15*c*.

The RAM 13 is a rewritable memory, and has a work area (not shown) for temporarily storing various kinds of data when the CPU 11 executes the control program 12*a*.

The DSP 14 is an operation device for processing digital signals. For example, the DSP 14 executes a control for shifting the pitch of an input sound (an input signal) that is inputted from the input terminal 51 and digitized by the ADC 16, and outputting the generated pitch-shifted sound to the DAC 17.

Figure 3:
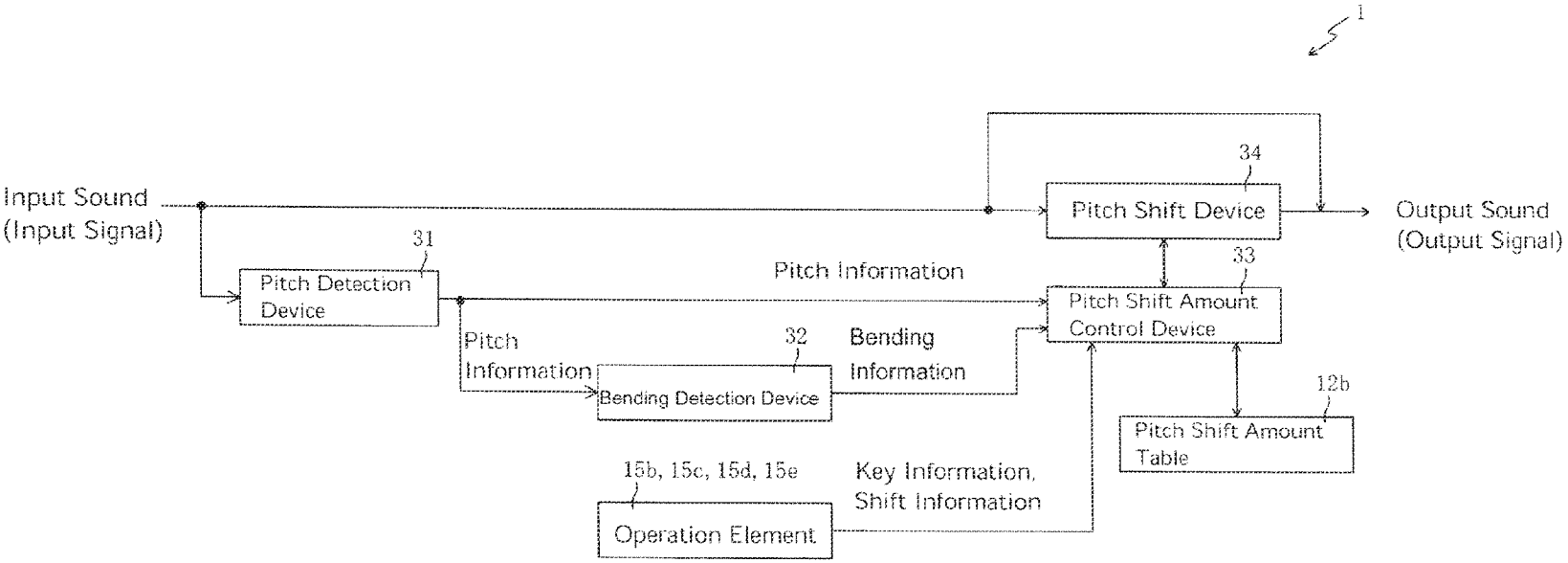
FIG. 3 is a functional block diagram of functions when a pitch shift device in accordance with an embodiment of the present invention is set in a harmony mode.

FIG. 3 is a functional block diagram of functions when the pitch shift device 1 in accordance with the present embodiment is set in the harmony mode. It is noted that the functions (the devices 31-34) shown in FIG. 3 would be achieved by collaborative processing by the CPU 11 and the DSP 14.

When the pitch shift device 1 is set in the harmony mode, input sound inputted in the input terminal 51 is supplied to a pitch detection device 31 and a pitch shift device 34, and also directly outputted from the output terminal 52. The pitch detection device 31 detects the pitch of the input sound, and supplies pitch information (information indicative of the detected pitch) to a bending detection device 32 and a pitch shift amount control device 33.

The bending detection device 32 detects, based on the pitch information supplied from the pitch detection device 31, whether or not bending is performed. In accordance with an example embodiment, the bending detection device 32 calculates the amount of pitch change per unit time (the rate of the pitch change) based on the pitch information, and detects that bending is performed when the amount of pitch change per unit time is smaller than a predetermined value (in other words, the rate of the pitch change is lower than the specified level). The bending detection device 32 supplies bending information indicative of the detection result (information indicative of the presence or absence of bending) to the pitch shift amount control device 33.

The pitch shift amount control device 33 receives inputs of key information set by the operation element 15*b* or 15*c* (a key information setting switch), and shift information set by the operation element 15*d* or 15*e* (a shift information setting switch). The pitch shift amount control device 33 reads a pitch shift amount table 12*b* entry corresponding to the key information and the shift information inputted, refers to the pitch shift amount table 12*b* readout, and decides the amount of pitch shift according to the pitch information supplied from the pitch detection device 31.

Further, the pitch shift amount control device 33 controls, based on the bending information supplied from the bending detection device 32, ON (execution)/OFF (non-execution) of an interpolation process of the pitch shift device 34. More specifically, the pitch shift amount control device 33 controls the pitch shift device 34 to execute the interpolation process when the bending information inputted from the bending detection device 32 indicates that bending is performed. On the other hand, the pitch shift amount control device 33 controls the pitch shift device 34 not to execute the interpolation process when the bending information inputted from the bending detection device 32 indicates that bending is not performed.

The pitch shift device 34 pitch-shifts the input sound based on the amount of pitch shift decided by the pitch shift amount control device 33, and outputs the same as a harmony sound from the output terminal 52. The pitch shift device 34 executes an interpolation process, for example, a control to make gentler (less blunt) the pitch shift change accompanying the change of the amount of pitch shift. This control is executed when the bending detection device 32 detects bending, and there is a change in the amount of pitch shift supplied from the pitch shift amount control device 33. The pitch shift device 1 in accordance with the present embodiment is configured such that the pitch shift device 34 executes an interpolation process, such that pitch-shifted sounds (harmony sounds) can be prevented from unnaturally changing during bending performance, and unnatural harmony sounds can be prevented from being outputted.

The interpolation process to be executed by the pitch shift device 34 may be, for example, a process to pass the amount of pitch shift decided by the pitch shift amount control device 33 through a low-pass filter. Another example of the interpolation process may be a process in which a value obtained by dividing the amount of pitch shift decided by the pitch shift amount control device 33 and the amount of pitch shift outputted the previous time in a specified ratio (for example, the amount of pitch shift equal to a half of the sum of the aforementioned amounts) is set as the amount of pitch shift this time.

As described above, in the harmony mode, the pitch shift device 1 according to an example embodiment outputs, from the output terminal 52, two-voice harmony composed of sound that is inputted from the input terminal 51 and directly outputted to the output terminal 52 (an input sound) and harmony sound that is outputted from the pitch shift device 34 to the output terminal 52.

Figure 4:
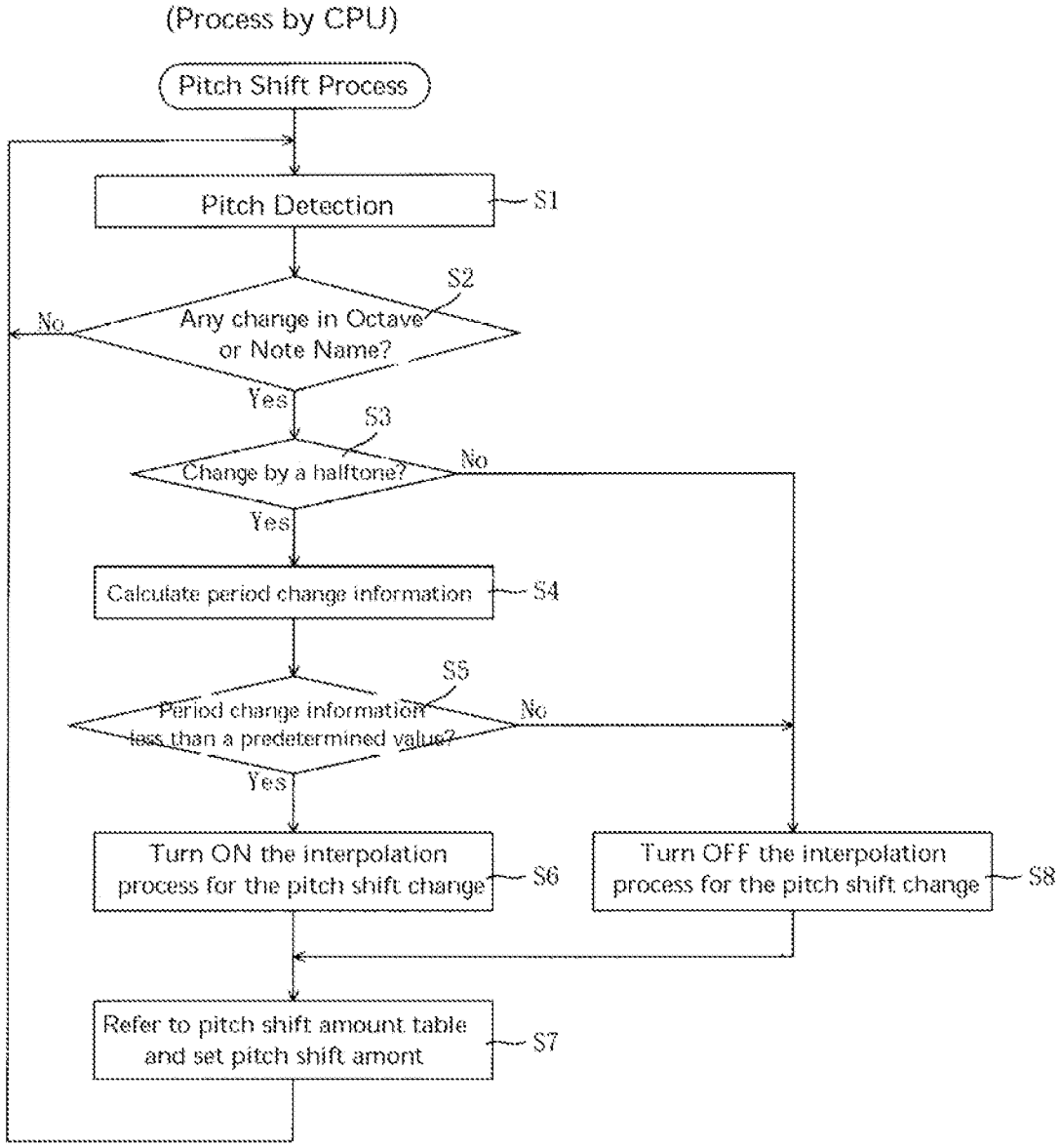
FIG. 4 is a flow chart of a pitch shift processing executed by the CPU in the harmony mode.

Referring to FIG. 4, an example of a pitch shift process executed by the CPU 11 when the pitch shift device 1 is set in the harmony mode is described. FIG. 4 is a flow chart of a pitch shift process to be executed by the CPU 11 in the harmony mode. It is noted that the pitch shift process is executed by the control program 12*a* stored in the ROM 12, and starts when the mode is switched to the harmony mode by operation of the operation element 15*a* (the mode changing switch).

In the pitch shift process, the CPU 11 executes a pitch detection process (51) of detecting the pitch of input sound (an input signal) to obtain pitch information. The pitch detection process (51) may be executed periodically at predetermined timings. The pitch information obtained by the pitch detection process (51) is stored in a storage area (not shown) provided within the RAM 13 or in a ring buffer in a mode in which the executed timings can be distinguished from one another. The distinguishable mode may be, for example, a mode of storing pitch information correlated with the executed timings of the process, a mode of storing pitch information at storage positions at which the timings can be distinguished, or the like.

Next, the CPU 11 judges, based on the pitch information obtained by the process in S1, whether or not the octave or the note name changed (S2). If it is judged that there is no change in the octave or in the note name (S2: No), the CPU 11 returns the process to S1, and executes the pitch detection process at the next execution timing.

On the other hand, if it is judged that there is a change in the octave or in the note name in S2 (S2: Yes), the CPU 11 judges whether or not the change is a change by a halftone (S3). If it is judged in S3 that there is a halftone change (S3: Yes), the CPU 11 calculates period change information of the pitch (the amount of pitch change per unit time) based on the pitch information (S4).

After the process in S4, the CPU 11 judges whether or not the calculated period change information is less than a predetermined value (S5). If it is judged in S5 that the period change information is less than the predetermined value, the CPU 11 judges that finger bending is performed (S5: Yes), and turns ON the interpolation process for the pitch shift change by the DSP 14 (S6). Thereafter, the process proceeds to S7. The CPU 11 judges that the pitch change is caused by bending performance as the bending performance causes a pitch changing rate lower (gentler) than a predetermined level. As the interpolation process is set to ON by the process in S6, the DSP 14 executes the interpolation for the pitch shift change.

On the other hand, when it is judged in S5 that the period change information exceeds the predetermined value (S5: No), the interpolation process for the pitch shift change by the DSP 14 is set to OFF (S8). Thereafter, the process proceeds to S7. The CPU 11 judges that the pitch change is caused by fret change as the normal performance causes a rapid pitch changing rate greater than the predetermined level. As the interpolation process for the pitch shift change is set to OFF by the process in S8, the interpolation process for the pitch shift change is not executed. Also, when it is judged in S3 that there is a change greater than a halftone (S3: No), the CPU 11 shifts the process to S7.

In S7, the amount of pitch shift to be instructed to the DSP 14 is set according to the pitch information obtained by the process in S1. The CPU 11 sets the amount of pitch shift, by referring to the pitch shift amount table 12*b* according to the key at performance set by the operation element 15*b* or 15*c*, and the shift information set by the operation element 15*d* or 15*e* (S7). The DSP 14 performs a pitch shifting on the input sound with the amount of pitch shift set by S7. After the process in S7, the CPU 11 returns the process to S1, and executes the pitch detection process at the next execution timing.

According to the pitch shift process described above, when it is judged (detected), by the processes in S3-S5 comprising the bending detection device, that bending is performed, the DSP 14 executes the interpolation process for the pitch shift change. As a result, if there is a change in the amount of pitch shift set by the process in S7, the pitch shift change accompanying the change in the amount of pitch shift can be made gentler (dulled). Therefore, according to the pitch shift device 1 of an embodiment of the present embodiment, an unnaturally sounding pitch change in the pitch-shifted sound (i.e., the harmony sound) at the time of bending performance can be alleviated or avoided, such that favorably sounding harmony sounds can be outputted.

Figure 5:
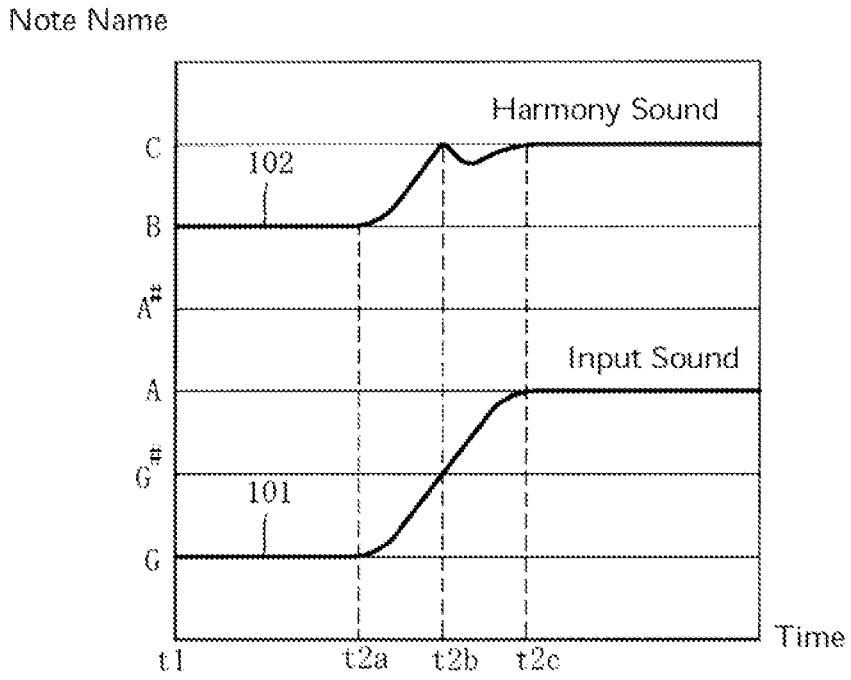
FIG. 5 is a graph representing an example of temporal changes in an input sound and a harmony sound when bending is performed when a pitch shift device according to an embodiment of the present invention is set in the harmony mode.

Referring to FIG. 5, effects provided by the pitch shift process described above (see FIG. 4) are described. FIG. 5 is a graph representing temporal changes in the pitch of each of the input sound 101 and the harmony sound 102 when bending is performed, when the pitch shift device 1 of the present embodiment is set in the harmony mode. The horizontal axis of the graph shows time, and the vertical axis shows note names of the respective input sounds (pitches). For the pitch shift amount table 12*b* to be referred to in order to obtain the harmony sound 102, a table that is used when the key information is set to C or Am, and the shift information is set to $+3^{rd}$ (see FIG. 7 (*a*)) is used.

With reference to FIG. 5, consider a case where the input sound 101 with the pitch "G" is inputted at time t1 and, thereafter, finger bending is started at time t2*a* to change the pitch of the input sound 101 from "G" to "A" at time t2*c*. In this case, as the pitch of the input sound 101 rises, the pitch of the harmony sound 102 rises from "B" at time t2*a* and thereafter, while keeping the pitch difference of four halftones with respect to the pitch of the input sound.

Then, at time t2*b*, when the pitch of the input sound 101 is detected as "$G^{\#}$" that is a halftone above "G," a judgment Yes is made in S3 in the pitch shift process of FIG. 4. As bending is performed, a judgment Yes is made in S5, and the process in S6 is executed, such that the interpolation process for the pitch shift change by the DSP 14 is set to ON. As a result, the DSP 14 executes the interpolation process for the pitch shift change, such that, at time t2*b* and thereafter, the pitch shift change accompanying the change in the pitch shift amount resulting from the change in the pitch of the input sound 101 from "G" to "$G^{\#}$" is dulled. Accordingly, although the pitch of the harmony sound would have rapidly dropped to "B" based on the pitch shift amount decided by the pitch shift amount table 12*b* (see FIG. 7 (*c*)) if nothing had been done, instead, the pitch shift change can be suppressed to a smaller degree. Therefore, according to the pitch shift device 1 of the present embodiment, an unnaturally sounding pitch change in the pitch-shifted sound can be alleviated or avoided, and acoustically pleasing harmony sounds can be outputted.

Figure 6:
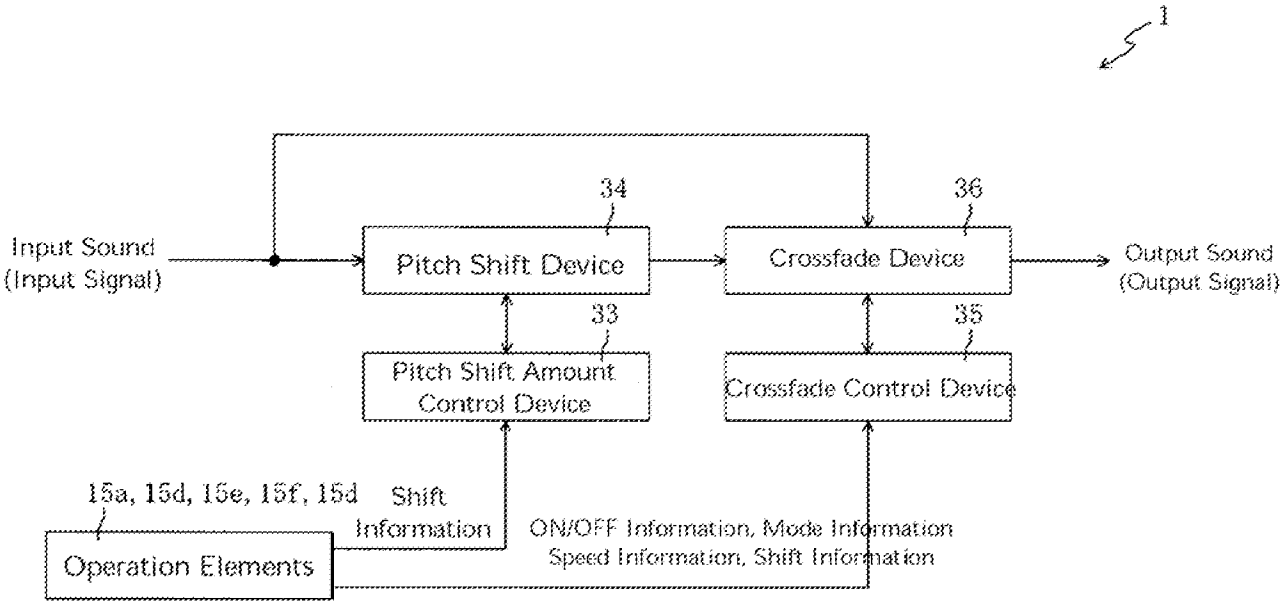
FIG. 6 is a functional block diagram of functions when a pitch shift device according to an embodiment of the present invention is set in a pitch shift mode.

Referring to FIG. 6, functions of the pitch shift device 1 in accordance with an embodiment of the present invention, when it is set in a pitch shift mode, are described. FIG. 6 is a functional block diagram of functions when the pitch shift device 1 is set in the pitch shift mode. Functions (devices 34-36) are achieved by collaborative processing by the CPU 11 and the DSP 14.

When the pitch shift device 1 is set in the pitch shift mode, input sound (an input signal) inputted in an input terminal 51 is supplied to a pitch shift device 34 and a crossfade device 36.

Shift information set by the operation element 15*d* or 15*e* (a shift information setting switch) is inputted in a pitch shift amount control device 33. The pitch shift amount control device 33 decides a pitch shift amount to be the pitch shift amount indicated by the inputted shift information. The pitch shift device 34 pitch-shifts the input sound based on the pitch shift amount decided by the pitch shift amount control device 33, thereby generating pitch-shifted sound. The pitch shift device 34 supplies the pitch-shifted sound to the crossfade device 36.

A crossfade control device 35 controls the crossfade device 36 based on information inputted from the operation elements 15*a*, 15*d*, 15*e*, 15*f* and 15*g*. More specifically, mode information indicative of the mode set by the operation element 15*a* (a mode changing switch) is inputted in the crossfade control device 35. ON/OFF information indicative of ON or OFF state of the effect set by the operation element 15*f* (an ON/OFF switching switch) is also inputted. Shift information set by the operation element 15*d* or 15*e* (a shift information setting switch) is also inputted. Also, speed information (information indicative of the first and second time) set by the operation element 15*g* (a time setting knob) is inputted.

When the mode information indicates the pitch shift mode, and the ON/OFF information indicates that the ON/OFF state of the effect is switched, the crossfade control device 35 controls the crossfade device 36 such that sound to be outputted from the crossfade device 36 is switched. The switching indicated by the ON/OFF information takes place when the effect is switched from OFF to ON by the operation element 15*f* or when it is switched in reverse.

The crossfade device 36 is controlled by the crossfade control device 35 to crossfade the input sound inputted from the input terminal 51 with the pitch-shifted sound supplied from the pitch shift device 34, thereby switching the output sound. It is noted that the input sound to be outputted from the crossfade device 36 may be called below as the "direct sound." In other words, when the effect is switched from OFF to ON, the crossfade device 36 decreases (fades out) the level of the direct sound being outputted with the passage of time, and increases (fades in) the level of the pitch-shifted sound with the passage of time, thus switching the output sound. On the other hand, when the effect is switched from ON to OFF, the crossfade device 36 decreases the level of the pitch-shifted sound being outputted with the passage of time, and increases the level of the direct sound with the passage of time, thus switching the output sound.

Also, when the mode information indicates the pitch shift mode, and the ON/OFF information indicates that the ON/OFF state of the effect is switched, the crossfade control device 35 sets a crossfade time period for executing crossfading (the period for executing crossfading) according to the shift information indicative of the pitch shift amount and the speed information indicative of a first time or a second time. More specifically, according to the shift information and the speed information, the switching speed between the direct sound and the pitch-shifted sound is predicted, and the crossfade time period is decided and set based on the prediction. Specifically, based on the shift information and the speed information, the greater the amount of pitch shift per unit time, the shorter the crossfade time period setting. Similarly, the smaller the amount of pitch shift per unit time, the longer the crossfade time period setting.

Example conventional pitch shift devices are typically configured such that an input sound is always passed through a pitch shift device similar to the pitch shift device 34. Therefore, any input sound, even when it is a sound that has no added effect (pitch shift), in other words, a sound with zero amount of pitch shift, passes through the pitch shift device. Because the pitch shift device is also a delay circuit, sounds relating to the user's performance action are outputted with a delay. Therefore, the delay (in other words, poor response to the performance action) can seem improper to the user.

In contrast, according to the pitch shift device 1 of the present embodiment, as shown in FIG. 6, when the effect is turned OFF, an input sound inputted in the input terminal 51 is outputted as the direct sound from the output terminal 52 without passing through the pitch shift device 34, such that sounds without any delay to the user's performance action (actual performance) can be outputted. Therefore, while the effect is turned OFF, the user can perform while listening to sounds (direct sounds) that do not seem improper or mismatched with respect to his/her own performance action.

However, when the effect is turned ON, input sounds must pass through the pitch shift device 34 that is also a delay circuit, such that pitch-shifted sounds are outputted as delayed sounds with respect to the actual performance. Therefore, when the effect is switched from ON to OFF, or it is switched in reserve, direct sounds without delay to the actual performance and pitch-shifted sounds delayed with respect to the actual performance are mutually switched. Therefore, if their timings are not matched with each other, an acoustical defect, such as, an unnatural node at the time of switching may occur.

Accordingly, further embodiments of the pitch shift device 1 are configured to predict the switching speed between the direct sound and the pitch-shifted sound based on the shift information that has been set by the operation element 15*d* or 15*e* (a shift information setting switch) and the speed information that has been set by the operation element 15*g* (the time setting knob), and decide a crossfade time period based on the prediction, such that acoustical defects that could occur at the time of switching between the direct sound and the pitch-shifted sound can be prevented or minimized.

Therefore, according to the pitch shift device 1 of the present embodiment, when the effect is turned OFF, the user can listen to direct sound that does not seem improper with respect to his/her own performance action. Also, acoustical defects which could otherwise occur at the time of switching between direct sound and pitch-shifted sound are prevented or minimized, such that the user's performance experience can feel comfortable and appropriate to the user.

According to embodiments of the pitch shift device 1, in the harmony mode in which the amount of pitch shift is decided using the pitch shift amount table 12*b*, when bending is detected, the process to interpolate (the interpolation process) for the pitch shift change accompanying the change in the amount of pitch shift is executed, as described above. As a result, the pitch shift change accompanying the change in the pitch shift amount can be made gentler (dulled). Therefore, an unnaturally sounding pitch change in the pitch-shifted sound (i.e., the harmony sound) at the time of bending performance, which could otherwise result from the configuration that uses the pitch shift amount table 12*b*, can be alleviated or avoided. Therefore, acoustically favorably sounding pitch-shifted sounds (harmony sounds) can be generated from performance sounds of an electronic musical instrument such as an electronic guitar, an electronic bass or the like, that can change pitch in the unit of a halftone. Also, such alleviation or avoidance of unnatural sounding pitch changes are handled by interpolation, such that it is not necessary to provide pitch shift amount tables dedicated for bending performance. Therefore, sounds can be output that seem appropriate and matched with the performance actions, while minimizing the need for additional memory.

Further, according to embodiments of the pitch shift device 1, as detection of bending is performed based on the amount of pitch change per unit time, trigger information (information indicative of plucking of a string), is made unnecessary, and bending while plucking the strings can be detected.

Also, embodiments of the pitch shift device 1 are configured such that, when the effect (pitch shift) is turned OFF, input sound inputted in the input terminal 51 is outputted as direct sound without passing through the pitch shift device 34. Therefore, while the effect is turned OFF, the user can listen to the outputted direct sound without feeling that the sound is improper or mismatched with respect to the user's own performance action. Then, when the effect is switched, switching between direct sound and pitch-shifted sound is predicted according to the setting made with the operation elements 15*d* and 15*e* and the operation element 15*g*, and the crossfading time for switching between these sounds is set. Therefore, acoustical defects that could otherwise occur at the time of switching between those sounds (the direct sound and the pitch-shifted sound) can be prevented or minimized.

While the invention has been described above based on example embodiments, the invention is not limited to those example embodiments, and it can readily be surmised that many modifications and improvements can be made without departing from the subject matter of the invention.

For example, the embodiment described above is configured such that detection of bending by the bending detection device 32 is performed based on the change rate of the pitch (pitch information) of input sound detected by the pitch detection device 31. However, other embodiments of the invention are not limited to this configuration. For example, in other embodiments, the bending detection method (a method in which a pitch change in input sound since detection of trigger information is monitored) described in Japanese Laid-open Patent Application HEI 6-12072 may be applied. Alternatively, in yet other embodiments, a mechanical bending detection method may be used. For example, any one of the following mechanical bending detection methods may be used. For example, a sensor for detecting the tension of each string may be provided on a stringed musical instrument that is subject to pitch shift, such that the presence or absence of bending is detected based on an input from the sensor (i.e., the degree of tension of each string). As another example, a sensor for detecting the position of each string (for example, an ultrasonic sensor) may be provided on a string musical instrument that is subject to pitch shift, such that the presence or absence of bending is detected based on an input from the sensor (i.e., the position of each string). As another example, a switch that turns on when bending is performed may be provided on a stringed musical instrument that is subject to pitch shift, and presence or absence of bending is detected based on an input from the switch.

In embodiments described above, the operation element 15*f* that can be a button switch, is used as an ON/OFF switching switch. However, in further embodiments, the pitch shift device 1 may be configured to be able to connect to a foot volume operator, and the user may operate the foot volume operator connected to the pitch shift device 1 by foot, to switch the effect between ON and OFF.

Also, in embodiments described above, the operation element 15*g* is configured to set both of the first time and the second time. However, in further embodiments, an operation element for setting the first time and another operation element for setting the second time may be provided.

Also, embodiments described above are configured such that, in the harmony mode, two-voice harmony composed of input sound and harmony sound is outputted. However, further embodiments may be configured such that harmony sound (pitch-shifted sound) alone is outputted from the output terminal 52.

What is claimed is:

1. A pitch shifting device comprising:

an input device configured to receive a musical sound signal of an electronic stringed musical instrument;

a pitch detection device that detects pitch information of the musical sound signal received by the input device;

a pitch information storage device that stores a group of pitch shift information, wherein the group of pitch shift information correlates the pitch information of the musical sound signal with pitch shift information for shifting the pitch of the pitch information;

a pitch shift information readout device that reads out pitch shift information corresponding to the pitch information detected by the pitch detection device from the group of pitch shift information stored in the pitch shift information storage device;

a pitch shift device that pitch-shifts the musical sound signal received by the input device based on the pitch shift information read out by the pitch shift information readout device; and a bending detection device that detects bending on the electronic stringed musical instrument, wherein the pitch shift device includes an interpolation device that performs, when bending is detected by the bending detection device, a control of interpolating for a pitch shift change in the musical sound signal accompanying a change in the pitch shift information read out by the pitch shift information readout device from the group of pitch shift information.

2. A pitch shifting device as recited in claim 1, wherein the pitch shift information storage device stores a plurality of groups of pitch shift information, and the pitch shifting device further comprising a selection device configured to select one group of pitch shift information from the plurality of groups of pitch shift information stored in the pitch shift information storage device, wherein the pitch shift information readout device reads pitch shift information corresponding to the pitch information detected by the pitch detection device from the one group of pitch shift information selected by the selection device.

3. A pitch shifting device as recited in claim 2, wherein the selection device comprises at least one manual operator.

4. A pitch shifting device as recited in claim 1, wherein the bending detection device detects string bending on the electronic stringed musical instrument based on the pitch information.

5. A pitch shifting device as recited in claim 1, wherein the bending detection device detects string bending on the electronic stringed musical instrument by determining whether a rate of pitch change in the pitch information is lower than a specified level.

6. A pitch shifting device as recited in claim 1, wherein the bending detection device detects string bending on the electronic stringed musical instrument by determining an amount of pitch change in the pitch information per unit of time and detecting whether the amount of pitch change per unit of time is smaller than a predetermined value.

7. A pitch shift device comprising:

an input device configured to receive a musical sound signal of an electronic stringed musical instrument;

a pitch detecting device that detects pitch information of the received musical sound signal;

a storage device storing a group of pitch shift information, wherein the group of pitch shift information correlates the pitch information of the musical sound signal with pitch shift information for shifting the pitch of the pitch information of the musical sound signal;

a controller configured to read out pitch shift information corresponding to the pitch information detected by the pitch detection device from the stored group of pitch shift information;

a pitch shifter configured to pitch-shift the received musical sound signal based on the read out pitch shift information; and a bending detector configured to detect bending on the electronic stringed musical instrument;

wherein, in response to the bending detector detecting bending, the pitch shifter is configured to interpolate pitch shift changes relative to pitch shift changes that would otherwise occur based on the read out pitch shift information.

8. A pitch shift device as recited in claim 7, wherein the storage device stores a plurality of groups of pitch shift information, the pitch shift device further comprising a selector configured to select one group of pitch shift information from the plurality of groups of pitch shift information, wherein the controller is configured to read out pitch shift information corresponding to the detected pitch information, from the one group of pitch shift information selected by the selector.

9. A pitch shift device as recited in claim 8, wherein the selector comprises at least one manual operator.

10. A pitch shift device as recited in claim 7, wherein, when bending is not detected, pitch-shifting of the received musical sound signal is carried out in accordance with un-interpolated pitch shift changes based on the read out pitch shift information.

11. A pitch shift device as recited in claim 7, wherein the bending detector detects string bending on the electronic stringed musical instrument based on the pitch information.

12. A pitch shift device as recited in claim 7, wherein the bending detector detects string bending on the electronic stringed musical instrument by determining whether or not a rate of pitch change in the pitch information is lower than a specified level.

13. A pitch shift device as recited in claim 7, wherein the bending detector detects string bending on the electronic stringed musical instrument by determining an amount of pitch change in the pitch information per unit of time and detecting whether the amount of pitch change per unit of time is smaller than a predetermined value.

14. A pitch shift method comprising:

receiving a musical sound signal of an electronic stringed musical instrument;

detecting pitch information of the received musical sound signal;

storing a group of pitch shift information, wherein the group of pitch shift information correlates the pitch information of the musical sound signal with pitch shift information for shifting the pitch of the pitch information of the musical sound signal;

reading out pitch shift information corresponding to the pitch information detected by the pitch detection device from the stored group of pitch shift information;

pitch-shifting the received musical sound signal based on the read out pitch shift information; and detecting bending on the electronic stringed musical instrument;

wherein, in response to detecting bending, the pitch-shifting of the received musical sound signal includes interpolating pitch shift changes relative to pitch shift changes that would otherwise occur based on the read out pitch shift information.

15. A pitch shift method as recited in claim 14, wherein storing a group of pitch shift information comprises storing a plurality of groups of pitch shift information, the method further comprising selecting one group of pitch shift information from the plurality of groups of pitch shift information, wherein reading out pitch shift information comprises reading out pitch shift information corresponding to the detected pitch information, from the one selected group of pitch shift information.

16. A pitch shift method as recited in claim 15, wherein selecting one group comprises receiving an input from at least one manual operator.

17. A pitch shift method recited in claim 14, wherein, when bending is not detected, pitch-shifting of the received musical sound signal is carried out in accordance with un-interpolated pitch shift changes based on the read out pitch shift information.

18. A pitch shift method as recited in claim 14, wherein detecting bending comprises detecting string bending on the electronic stringed musical instrument based on the pitch information.

19. A pitch shift method as recited in claim 14, wherein detecting bending comprises detecting string bending on the electronic stringed musical instrument by determining whether or not a rate of pitch change in the pitch information is lower than a specified level.

20. A pitch shift method as recited in claim 14, wherein detecting bending comprises detecting string bending on the electronic stringed musical instrument by determining an amount of pitch change in the pitch information per unit of time and detecting whether the amount of pitch change per unit of time is smaller than a predetermined value.

* * * * *